US005358153A

United States Patent [19]

Caldwell et al.

[11] Patent Number: 5,358,153

[45] Date of Patent: Oct. 25, 1994

[54] MIXING LID INCLUDING A POURING DEVICE FOR CONTAINERS USED ON STIRRING MACHINES

[75] Inventors: Gary L. Caldwell, Broomfield; Francis A. Heckendorf, Jr., Ft. Collins; Leslie E. Jones, Arvada, all of Colo.; Patrick W. Powell, deceased late of Santa Rosa, Calif. By Joan Powell, Legal Representative.

[73] Assignee: E. I. Du Pont de Nemours and Company, Wilmington, Del.

[21] Appl. No.: 814,421

[22] Filed: Dec. 30, 1991

[51] Int. Cl.[5] ..... B67D 3/00; B67D 5/06

[52] U.S. Cl. ..... 222/505; 222/487; 222/511; 222/561; 222/506

[58] Field of Search ..... 222/470–474, 222/484, 505, 559, 561, 511, 512, 487

[56] References Cited

U.S. PATENT DOCUMENTS

| | | | |
|---|---|---|---|
| 2,257,370 | 9/1941 | DeKay | 222/511 X |
| 2,357,421 | 9/1944 | Murray | 222/505 |
| 2,676,472 | 4/1954 | Paddock | 222/511 X |
| 3,021,118 | 2/1962 | Dedoes | 222/561 X |
| 3,041,052 | 6/1962 | Dedoes | 222/484 |
| 3,937,372 | 2/1976 | Bode | 222/512 X |
| 4,750,648 | 6/1988 | Krydiak | 222/484 |
| 4,793,528 | 12/1988 | Krzywdziak | 222/487 |
| 4,921,146 | 5/1990 | Salzmann | 222/472 X |
| 5,020,700 | 6/1991 | Krzywdziak et al. | 222/561 X |

*Primary Examiner*—Andres Kashnikow
*Assistant Examiner*—Kenneth DeRosa
*Attorney, Agent, or Firm*—Hilmar L. Fricke

[57] ABSTRACT

A mixing lid with a pouring device for containers used on stirring machines includes an integral one piece slidable closure for a pouring spout and has a first rearward opened pouring position and a second forward closed sealed position. A removably secured front slide closure plate is provided for closing the spout in the second forward closed position. The slidable closure includes a rear rocker engagement member. An operating lever has front and rear ends and is pivotally mounted on the lid intermediate the ends thereof. The lever includes manual press portion on the rear end and a rocker on the front end engageable with the rocker engagement member. A retaining spring engageable with the integral one piece slidable closure and the removably secured front slidable closure plate is provided for maintaining the removably secured slidable closure plate in contact with the pouring spout when the integral one piece slidable closure is in the first and second positions. A tension spring connects the lid with the integral one piece slidable closure for maintaining the one piece slidable closure in the second closed position.

8 Claims, 4 Drawing Sheets

MIXING LID INCLUDING A POURING DEVICE FOR CONTAINERS USED ON STIRRING MACHINES

FIELD AND BACKGROUND OF INVENTION

The present invention is directed to a lid with an adjustable pouring mechanism, and more particularly to a mixing lid with a flow control pouring device for containers used on stirring machines.

The lids of this type are particularly adapted to be mounted on the primary color or paint containers for automobile body work and are used in connection with paint stirring machines. The lids typically include a stirring assembly and are mounted on top of an open container that includes tint or primary color which is used to formulate a refinish paint. In order to prevent the pigments in the tint from settling out, the mixing or stirring assembly is automatically rotated several times a day by connecting to a rotating device which turns the impellers of the mixing assembly inside the container. In this manner, the tint is maintained in a homogeneously mixed state and properly formulated refinish paint is obtained.

Conventional lids of this type, however, suffer from many disadvantages, such as leaky shaft, pouring inaccuracy due to improperly metered or wide spout opening, clogging up of the spout, the lid jamming open, the sticking of the spout opening due to the paint residue accumulating around the spout area, the lid snapping off the paint container due to weak metal seams, the clogging up of the vent hole, etc. In addition, the conventional lids are expensive to manufacture and require time consuming assembly. Illustrative examples of the conventional lids are disclosed in U.S. Pat. Nos. 4,750,648 issued Jun. 14, 1988 to Krydiak and 4,793,528 issued Dec. 27, 1988 to Krzywdziak.

In view of the foregoing, there is a need in the industry, for a mixing lid with a pouring device which is relatively inexpensive to manufacture, easy to assemble, and which does not have the drawbacks associated with conventional lids of that type.

OBJECTS AND SUMMARY OF THE INVENTION

The principal object of the present invention is to provide a mixing lid with a flow control pouring device for containers used on stirring machines which allows for precise pouring of the contents of the container.

One main object of the invention is to provide a lid with a unique mixing assembly which prevents, for example, the pigments in a tint from settling out.

An additional object of the present invention is to provide a mixing lid with a pouring device which prevents cake build-up on the pouring spout and the adjacent areas thereof.

Yet an additional object of the present invention is to provide a mixing lid with a pouring device which prevents clogging of the vent hole.

An additional object of the present invention is to provide a mixing lid with a pouring device with an improved mixing blade assembly for homogeneous mixing of the pigment.

Still yet an additional object of the present invention is to provide a mixing lid with a pouring device which includes an ergonomically designed grab handle with a convenient thumb lever for easy pouring of the contents of the container.

Yet an additional object of the present invention is to provide a mixing lid with a pouring device which forms a tighter seal about the container top and prevents leakage, particularly around from the area surrounding the shaft of the mixing assembly.

A further object of the present invention is to provide a mixing lid with a pouring device which makes it is easy to lock the lid on the top of a container.

Yet a further object of the present invention is to provide a mixing lid with a pouring device which is inexpensive to manufacture and is easy to assemble.

In summary, the main object of the present invention is to provide a mixing lid with a pouring device which allows for tighter fitting on the top of a container, better mixing action, more accurate pouring, improved flow control, self-cleaning of the spout, and easier pouring with an ergonomically designed handle.

BRIEF DESCRIPTION OF THE DRAWINGS

The above and other objects, advantages and novel features of the present invention will become apparent from the following detailed description of the preferred embodiment of the invention illustrated in the accompanying drawings, in which.

DETAILED DESCRIPTION OF THE INVENTION

Figure 1:
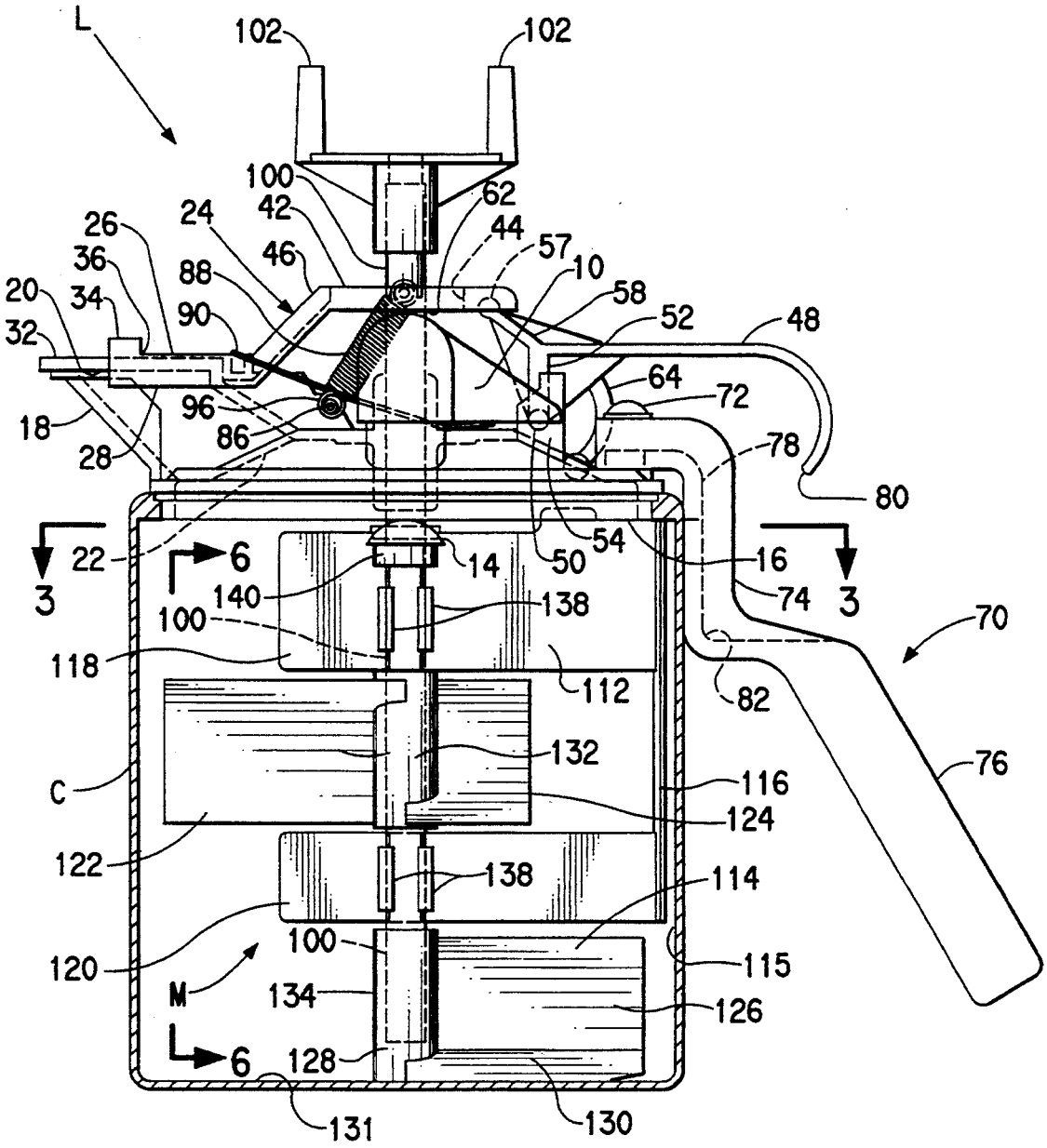
FIG. 1 is an elevational view of the mixing lid of the invention, shown mounted on top of a container.

In reference to FIGS. 1–5 of the drawings, the lid L of the invention is generally mounted so as to form a sealing cover on an opened paint or tint container C for a stirring machine (not shown) by means of a pair of diametrically opposed lid locking lugs 10 and 12. Each locking lug 10 and 12 is provided with a suitable cam 14 which fastens to the inside rim 16 of container C (FIG. 1). The lid L includes a propeller-driven mixing assembly M, described below in detail and best shown in FIGS. 1, 3 and 7.

As best shown in FIGS. 1–2 and 4–5, lid L includes a pouring spout 18 projected from the outer periphery thereof and in communication with the exterior by opening 20 and the interior of the container C by opening 22. An integral, one piece generally S-shaped closure member 24 is slidably mounted on the spout 18. In particular, the front portion 26 of closure member 24 includes a pair of generally L-shaped lateral guides 28 for preventing lateral movement of the closure number 24 relative to spout 18, best shown in FIGS. 1 and 2.

The lateral guides 28 define therebetween a recess 30 for holding or accommodating a sliding closure plate 32 therein, best shown in FIGS. 1–2 and 4–5.

A pair of opposed, generally T-shaped members 34 are provided on front portion 26 of the closure member 24 for securely holding closure plate 32. Further, closure plate 32 is provided with opposed, recessed projections 36 that correspond with and receive the stems of T-shaped finger members 34. The closure plate 32 is further provided with a transverse recess 38 for receiving a corresponding projection 40 of closure member 24 provided behind T-shaped finger members 34. In this manner, closure plate 32 is securely held down in tight engagement with spout opening 20.

Figure 4:
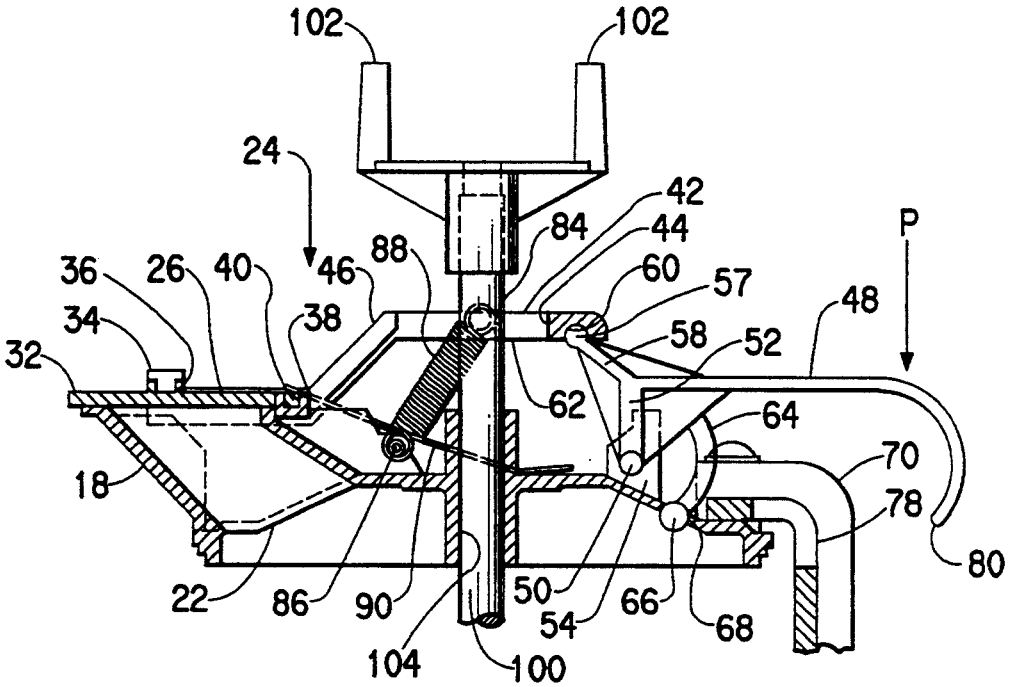
FIG. 4 is a partial sectional view taken along line 4—4 of FIG. 2 showing the integral closure member in the closed resting position.
Figure 5:
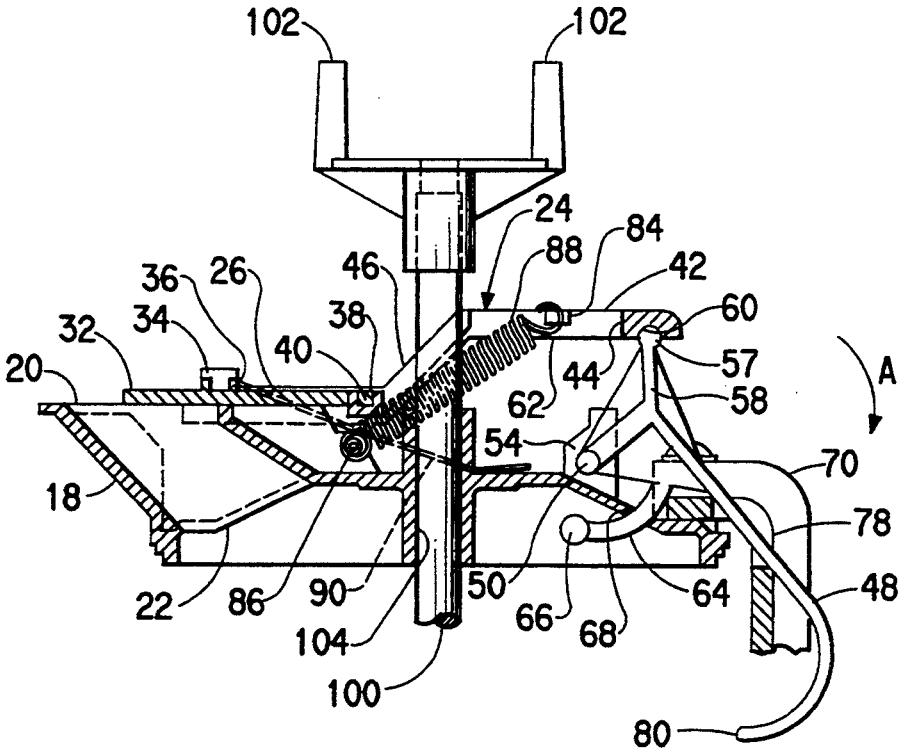
FIG. 5 is a view similar to FIG. 4, showing the integral closure member in the pouring or open, unsealed position.

The rear portion 42 of closure member 24, which is elevated in respect of front portion 26, is in the form of a yoke defining a recess 44 therein, FIG. 4 and 5. The front and rear portions 26 and 42 are connected by a rearwardly inclined intermediate portion 46. An operating lever 48 is pivotally connected to the lid L by pin 50 connected to arm 52 thereof extending between raised projections 54 and 56. Another arm 58 of lever 48 includes pin-shaped end 57 which is pivotally-received in recess 60 on the underside 62 of rear portion 42.

As best shown in FIGS. 4 and 5, a curved tail pin 64 extends downwardly from lever 48 and includes a rounded sealing member 66 having a diameter slightly less than the diameter of air hole 68 and larger than the diameter of tail pin 64. Therefore, when lever 48 is in the resting position, shown in FIG. 4, sealing member 66 substantially closes off air hole 68. On the other hand, when the lever 48 is pivoted downwardly, as shown by arrow A in FIG. 5, the sealing member 66 moves away from air hole 68 and the lesser diameter tail pin 64 extends through air hole 68 thereby opening the same.

As best shown in FIG. 1, an ergonomically designed grab handle 70 is mounted to the lid L behind air hole 68 by screws 72. Handle 70 includes a downwardly extending portion 74 that engages container C, and a gripping portion 76 which extends outwardly away from container C. The portion 74 has a cavity 78 within which lever 48 extends when pivoted downwardly as shown in FIG. 5. When the lever 48 is pivoted downwardly, as shown by arrow A in FIG. 5, the tip portion 80 thereof comes to rest against bottom corner 82 of cavity 78, FIG. 1. In this manner, handle cavity 78, in particular corner 82 thereof, functions as a stop to limit the downward rotational movement of lever 48 relative to the lid L.

Figure 2:
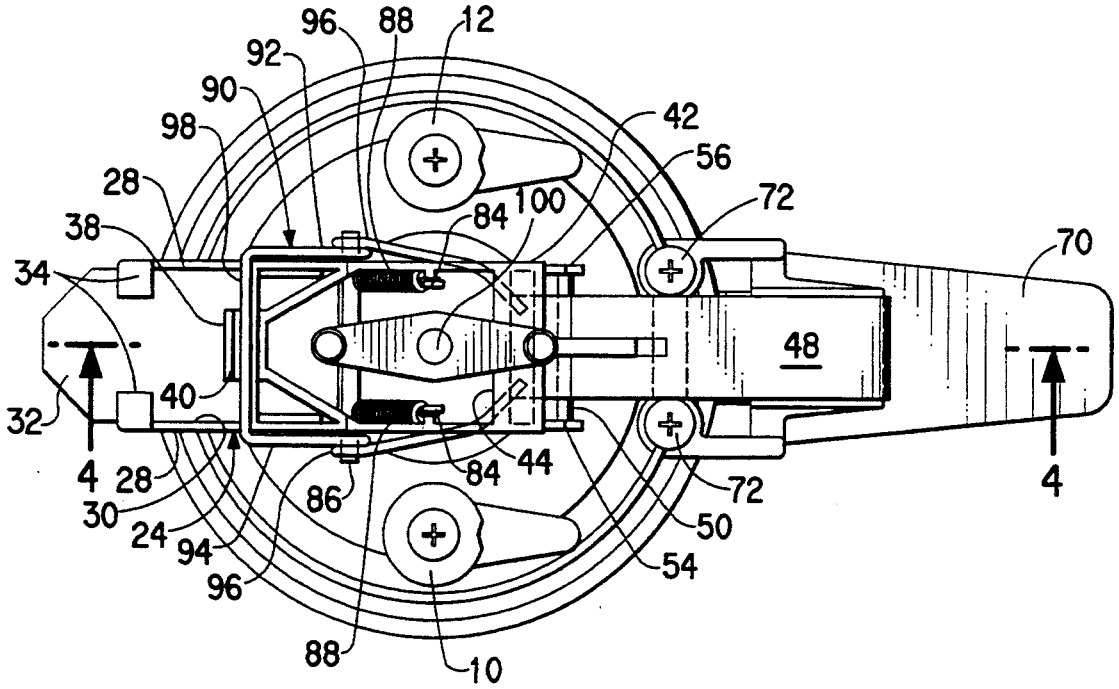
FIG. 2 is a top plan view thereof.

As best shown in FIG. 2, a pair of mounting ears 84 extends into recess 44 of yoke 42. A mounting pin 86 is provided behind spout 18 and extends transversely thereto. A pair of coil springs 88, extending substantially parallel to one another, are each attached on one end to the corresponding ear 84, and on the other end thereof to the corresponding end of mounting pin 86. The springs 88 keep the rear portion of 42 of closure 24 downwardly pivoted against lever 48, and further cause it to assume its initial resting closed position shown in FIG. 4, from the open position shown in FIG. 5, when the pressure P on lever 48 is released.

In order to maintain front portion 26 of closure member 24 in tight engagement with spout 18, and to keep closure plate 32 in position, when closure member 24 is switched between open and closed positions, a generally U-shaped compression spring 90 is provided, FIGS. 1–2 and 4–5. The spring 90 has arms 92 and 94 each of which includes a loop 96 which is secured to the ends of mounting pin 86, best shown in FIG. 1 and 2. The arms 92 and 94 extend rearwardly of spout 18 on either side of mixing assembly shaft 100. The intermediate arm 98 of spring 90 extends transversely across the top of closure plate 32 and applies a downward pressure thereon as well as on the lateral guides 28.

As best shown in FIGS. 1, 4–5 and 7, the mixing assembly M includes a support shaft 100 having at one end ears 102 which are engaged by the drive mechanism of a stirring machine. The shaft 100 extends centrally downwardly through recess 44 of yoke 42 and passageway 104 in the lid L, FIGS. 4 and 5.

Figure 3:
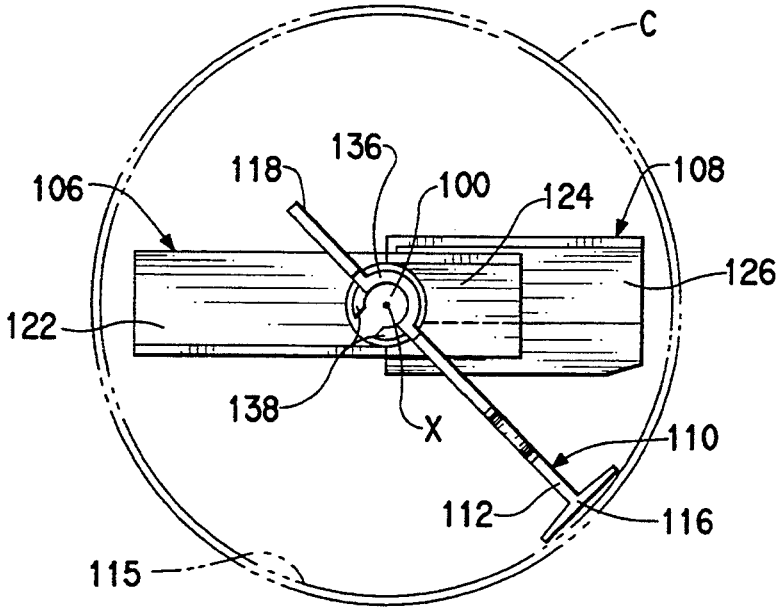
FIG. 3 is a partial sectional view taken along line 3—3 of FIG. 1, showing the container in broken lines.
Figure 7:
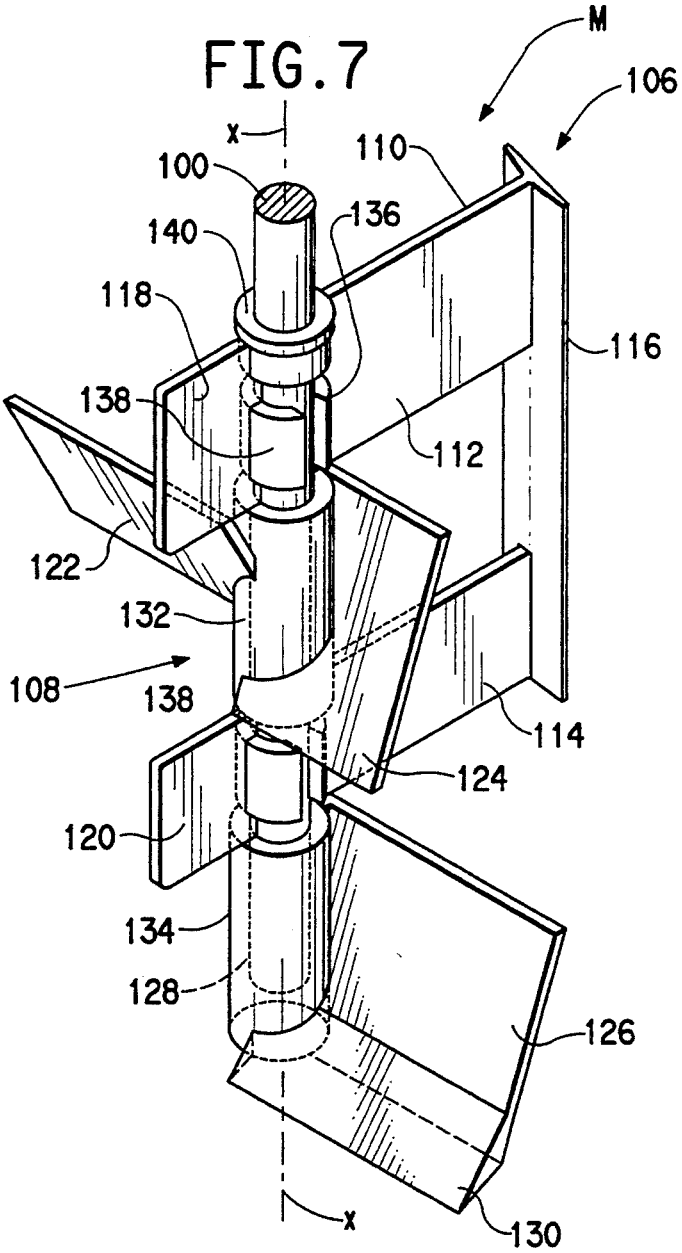
FIG. 7 is a perspective view of the mixing blade assembly of the lid shown in FIG. 1, shown without the ears.

As best shown in FIGS. 3 and 7, mixing assembly M includes a free-floating impeller system 106, and a power driven impeller system 108 which rotates simultaneously with the rotation of shaft 100.

The free-floating impeller system 106 includes a generally U-shaped impeller 110 having generally planar sub-impellers 112 and 114 connected by a vertically extending generally planar sub-impeller 116. The sub-impellers 112 and 114 extend in a common plane and generally parallel to the longitudinal axis x of shaft 100. The sub-impeller 116 extends in a plane intersecting the plane of sub-impellers 112 and 114 and further orthogonal thereto. The sub-impeller 116 therefore extends in a plane generally parallel to the inside wall 115 of the container C and in close proximity thereto, FIG. 3. Thus, when U-shaped impeller 110 is rotated. sub-impeller 116 thereof sweeps the inside wall 115 of container C. Two planar sub-impellers 118 and 120, shorter in length than the corresponding sub-impellers 112 and 114, respectively, extend in the same plane as the plane of sub-impellers 112 and 114, and are positioned diametrically opposite thereto on shaft 100.

As best shown in FIGS. 1 and 7, the power driven impeller system 108 includes generally planar impellers 122 and 124 extending generally opposite to each other on the shaft 100. The impellers 122 and 124, however, extend in planes that intersect each other, as well as the shaft axis x. As best shown in FIG. 1, the impeller 122 is longer in length than the impeller 124. The impellers 122 and 124 are positioned on shaft 100 so as to be between sub-impellers 112 and 114.

The power driven impeller 108 further includes a planar bottom impeller 126 mounted on bottom 128 of shaft 100 below sub-impeller 114. The impeller 126 extends in a plane generally parallel to the plane of short sub-impeller 124, FIG. 7. A scraper or sweeping blade 130 is integrally formed with a single mounting sleeve 132 through which shaft 100 extends. Likewise, bottom impeller 126 and blade 130 are also formed integral with a single sleeve 134 for mounting on shaft bottom 128.

Figure 6:
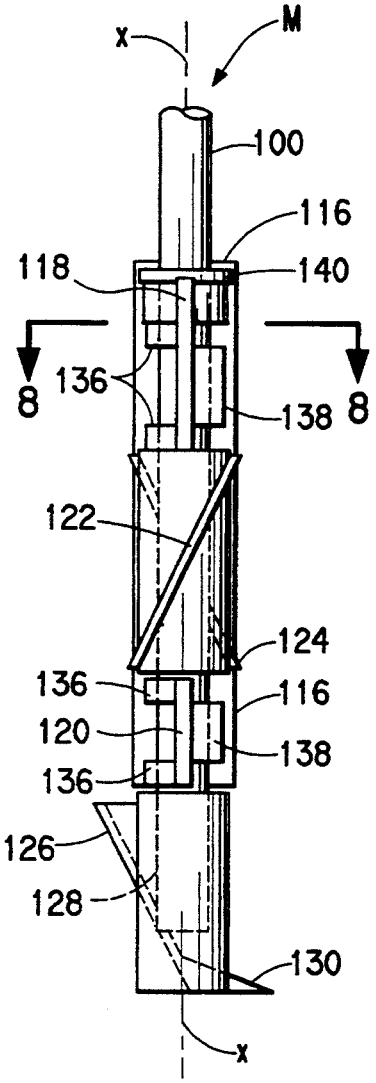
FIG. 6 a partial view taken along line 6—6 of FIG. 1.
Figure 8:
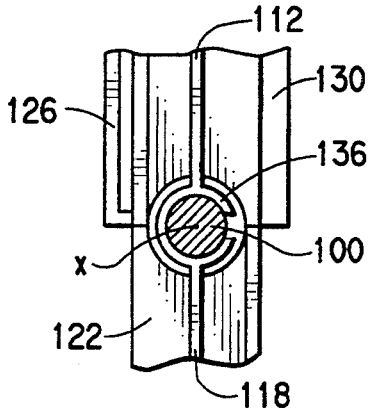
FIG. 8 is a partial sectional view taken along line 8—8 of FIG. 6.

As best shown in FIGS. 1, 6 and 8, U-shaped impeller 110 is mounted on shaft 100 by integrally formed generally C-shaped axially spaced sleeves 136 that partially surround shaft 100, and facing retainers 138. In FIGS. 1, 6 and 7, reference numeral 140 designates a retaining sleeve for mixing assembly M. As best shown in FIGS. 3 and 6, facing retainers 138 are positioned on shaft 100 between C-shaped sleeves 136 and are oriented generally opposite thereto.

Figure 9:
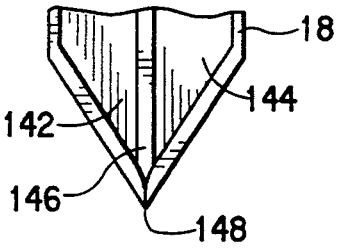
FIG. 9 is a partial top plan view of the lid spout in the open unsealed position.

As shown in FIG. 9, spout 18 includes side walls 142 and 144 forming a narrow fluid passageway 146 at their juncture in the center. The passageway 146 is finely metered at pouring end 148.

USE AND OPERATION

In use, the lid L, including mixing assembly M, is mounted on top of container C. In the closed resting position, shown in FIGS. 1, 2 and 4, the closure plate 32 substantially seals the opening 20 of spout 18. When it is desired to pour the contents of the container, a downward pressure P (FIG. 4) is applied on lever 48 so as to pivot the same downwardly, shown by arrow A in FIG. 5. The pivoting of lever 48 in this manner causes S-shaped closure member 24 to be translate away from spout 18 (towards the right in FIGS. 4 and 5), so as to move plate 32 for unsealing spout opening 20. While maintaining the pressure on lever 48, an operator can simple tilt the container C to pour out the contents therefrom. It should be noted that upon release of pressure P from lever 48, the closure number 24 will return to its initial resting position (FIG. 4) due to the force exerted by springs 88. When it is desired, the container C including the lid L thereon can be connected to a stirring machine, in order to rotate the shaft 100 for thereby mixing, for example, the paint or tint in the container.

As noted above, the closure plate 32 is maintained in tight engagement with spout opening 20. Therefore, when closure member 24 returns to its initial resting position due to the force exerted by spring 88, any paint or residue remaining about spout opening 20 would be wiped off therefrom by sliding action of plate 32. This self-cleaning action prevents paint residue from depositing on spout 18 leading to inaccurate or malpouring.

While this invention has been described as having a preferred design, it is understood that is capable of further modifications, and uses and/or adaptations of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A lid including a pouring device for containers used on stirring machines, comprising:

a) a pouring spout on said lid;

b) an integral one piece slidable closure for said pouring spout having a first rearward opened pouring position and a second forward closed sealed position;

c) said integral one piece slidable closure having a removably secured front slide closure for closing said spout when said slidable closure is in said second forward closed sealed position;

d) said integral one piece slidable closure having a pair of laterally spaced fingers for securing thereto said removably secured front slide closure;

e) said integral one piece slidable closure having a recess positioned behind said fingers;

f) said slidable closure having a rear rocker engagement means;

g) said integral one piece slidable closure having a yoke with a recess positioned adjacent to said rear rocker engagement means thereof;

h) an operating lever having front and rear ends pivotally mounted on said lid intermediate said ends and including a manual actuator on said rear end and a rocker at said front end engageable with said rear rocker engagement means;

(i) spring retaining means being received by said recess of said integral one piece slidable closure and engaging said removably secured front slide closure for maintaining said front slide closure in contact with said pouring spout when said integral one piece slidable closure is in both said first and second positions;

j) spring means under tension connecting said lid with said integral one piece slidable closure for normally maintaining and biasing said slidable closure in said second closed position.

2. The lid of claim 1, and including:

(a) a generally vertically extending mixer means positioned in said recess.

3. The lid of claim 2 which includes:

(a) a mounting pin positioned adjacent said spout in advance of said mixer; and wherein (b) said spring comprises a pair if opposed springs having first ends secured to said yoke and second ends secured to said mounting pin.

4. The lid of claim 3, wherein:

a) said yoke includes a pair of laterally spaced ears extending into said recess for thereby securing the corresponding first ends of said pair of springs.

5. The lid of claim 1, wherein:

a) said spring retaining means comprises a spring having a pair of ears for positioning on a mounting pin.

6. The lid of claim 1, which includes:

a) a mixer comprises a support shaft for rotation by a drive;

b) a first impeller fixedly mounted on said shaft; and c) a second impeller mounted on said shaft and freely rotatable thereabout, said second impeller being generally U-shaped in configuration and partially surrounds said first impeller.

7. The lid of claim 6, wherein said first impeller having two nonconnected segments, with the axial side of each segment of said first impeller being rotated to an angle off of the perpendicular.

8. The lid of claim 7, wherein said second impeller having at least two segments connected by a generally vertical perpendicular plane, said segments of said second impeller separated by one segment of said fixed first impeller.

* * * * *